US005794093A

United States Patent [19]

Kinoshita et al.

[11] Patent Number: 5,794,093

[45] Date of Patent: Aug. 11, 1998

[54] AUTOMATIC DEVELOPING MACHINE

[75] Inventors: Togo Kinoshita; Masanori Inoshita; Ryousuke Matumoto, all of Wakayama, Japan

[73] Assignee: Noritsu Koki Co., Ltd., Wakayama, Japan

[21] Appl. No.: 807,814

[22] Filed: Feb. 26, 1997

[30] Foreign Application Priority Data

Feb. 26, 1996 [JP] Japan ..... 8-037847
Feb. 28, 1996 [JP] Japan ..... 8-041118

[51] Int. Cl.[6] ..... G03D 13/02

[52] U.S. Cl. ..... 396/636; 396/641

[58] Field of Search ..... 396/604, 606, 396/617, 626, 636, 641; 134/122 P, 64 P; 430/398–400

[56] References Cited

U.S. PATENT DOCUMENTS 3,916,426 10/1975 Bown ..... 396/614
4,945,934 8/1990 Vaughn, IV ..... 396/626
5,144,474 9/1992 Keable et al. ..... 396/617
5,179,404 1/1993 Bartell et al. ..... 396/617
5,185,624 2/1993 Fischer ..... 396/617
5,266,994 11/1993 Desai et al. ..... 396/604
5,365,299 11/1994 Desai ..... 396/626

FOREIGN PATENT DOCUMENTS 6-83019 3/1993 Japan ..... 396/942

OTHER PUBLICATIONS

Patent Abstracts of Japan, vol. 013, No. 355 (P-914), 9 Aug. 1989 & JP 01 114847 A (Fuji Photo Film Co Ltd), 8 May 1989, * abstract *.

Patent Abstracts of Japan, vol. 018, No. 362 (P-1766), 7 Jul. 1994 & JP 06 095334 A (Fuji Photo Film Ltd), 8 Apr. 1994, * abstract *.

*Primary Examiner*—D. Rutledge

*Attorney, Agent, or Firm*—Wenderoth, Lind & Ponack, L.L.P.

[57] ABSTRACT

An automatic developing machine for developing photosensitive material while feeding the photosensitive material through a feed path through which developing solution is circulated. The feed path has a narrow, slit-shaped section. The feed path is defined between a pair of opposed wall members, one of which can be disassembled from the other. The members planted with fiber are detachably fitted on guide surfaces of the wall members which face an emulsion surface of the photosensitive material.

5 Claims, 6 Drawing Sheets

AUTOMATIC DEVELOPING MACHINE

BACKGROUND OF THE INVENTION

This invention relates to an automatic developing machine for developing photosensitive material such as photographic film or printing paper.

A conventional automatic developing machine has a plurality of tanks in which are stored different kinds of developing solutions including a developer, bleacher, fixer and stabilizer. Photosensitive material is immersed in these solutions one after another for development.

To save raw material and protect the environment, it is desirable to limit the use of these solutions to a minimum.

For this purpose, Unexamined Japanese Patent Publication proposes an automatic developing machine having a rack mounted in each tank, the rack being formed with a feed path having a narrow slit-shaped section with a width of 0.3 mm–5 mm. Developing solutions are discharged at the emulsion surface of photosensitive material being fed through the slit-shaped path.

This slit type automatic developing machine has a problem in that photosensitive material tends to suffer scratches on its emulsion surface by coming into sliding contact with the surrounding wall because the feed path is narrow.

Conventional solutions to this problem include reducing the contact surface with photosensitive material by forming irregularities on the surface defining the feed path, and providing rollers for guiding photosensitive material.

But the former method cannot completely prevent scratches on photosensitive material. The latter arrangement needs extra space for mounting rollers, which increases the clearance of the feed path, which in turn increase the amount of developing solution needed.

One slit type automatic developing machine has slit-shaped feed paths formed in the tanks themselves to feed photosensitive materials through these feed paths.

This developing machine also has the problem of scratches on the emulsion surface of photosensitive material while the material is being fed through the feed path.

In order to solve this problem, i.e. in order to prevent scratches from being formed on photosensitive material, Unexamined Japanese Patent Publication 1-114847 proposes to provide thread members on the wall surface of the feed path. Since the thread members are adhesively affixed, replacement is extremely difficult when they buckle or become worn. This developing machine thus has maintenance-related problems.

An object of this invention is to provide a slit type automatic developing machine of the kind having flexible fibers provided on the wall surface defining the feed path through which photosensitive material is fed to prevent scratches from being formed on the photosensitive material, and more particularly to provide a developing machine of the above type that permits easy maintenance when the fibers partially or entirely buckle or become worn.

SUMMARY OF THE INVENTION

According to this invention, there is provided an automatic developing machine for developing photosensitive material while feeding the photosensitive material through a feed path through which developing solution is circulated, the feed path having a narrow, slit-shaped section, the feed path being defined between a pair of opposed wall members, one of which can be disassembled from the other, wherein members planted with fiber are detachably fitted on guide surfaces of the wall members which face an emulsion surface of the photosensitive material.

The feed path may be formed in a rack immersed in a tank filled with developing solution or in the tank itself.

In the arrangement in which the feed path is formed in the rack, a pair of rack plates as the wall members are detachably mounted at the front and back sides of the rack.

If the feed path is formed in the tank, a pair of plate members as the wall members are detachably mounted at the front and back sides of the tank.

The fiber-planted members may be detachably mounted on the wall members to cover their entire guide surfaces or may be detachably fitted in a plurality of grooves formed in the guide surfaces of the wall members.

In order to minimize frictional resistance between the fibers and photosensitive material being fed through the feed path, the grooves preferably comprise first and second grooves inclined in opposite ways to each other with respect to a straight line perpendicular to the direction in which photosensitive material is fed through the feed path.

In the arrangement in which fibers are planted by piercing them through the base and a latex compound layer is provided on the back of the base, the latex compound layer effectively prevents premature fall-out of the fibers. This prolongs the life of the fiber-planted members and thus the intervals between replacements of the members.

When fibers of any of the fiber-planted members buckle or become worn, the wall members disassembled and the old fiber-planted members are replaced with new fiber-planted members.

Other features and objects of the present invention will become apparent from the following description made with reference to the accompanying drawings, in which:

DETAILED DESCRIPTION OF THE PREFERRED EMBODIMENT

Figure 1:
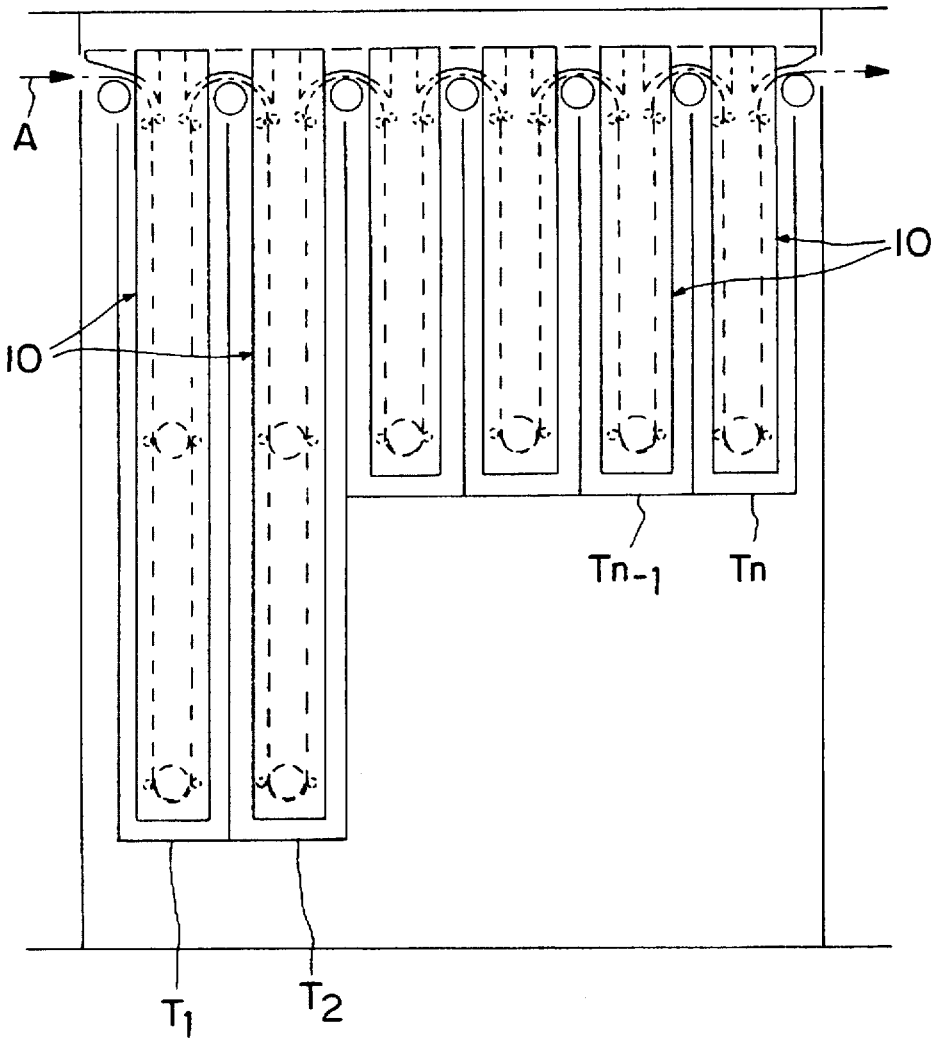
FIG. 1 is a schematic view of an automatic developing machine according to this invention.

Embodiments of this invention are now described with reference to the drawings. FIG. 1 schematically shows an automatic developing machine according to the present invention. The developing machine has a plurality of tanks arranged in a row and filled with different developing solutions including a developer, bleacher, fixer and stabilizer. In each tank, a rack 10 for guiding photosensitive material A is immersed in the solution.

Figure 2:
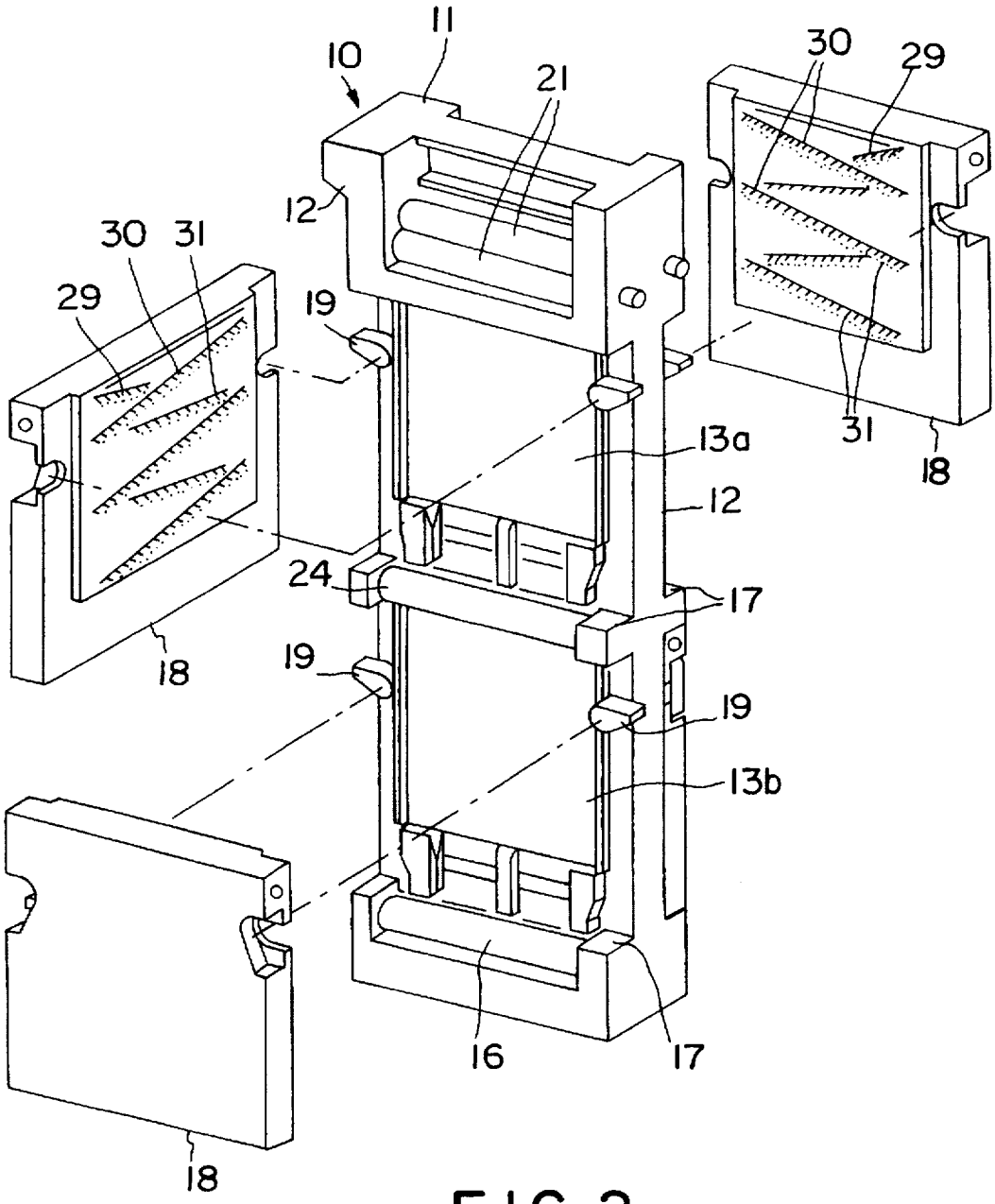
FIG. 2 is an exploded perspective view of a rack of the device of FIG. 1.
Figure 3:
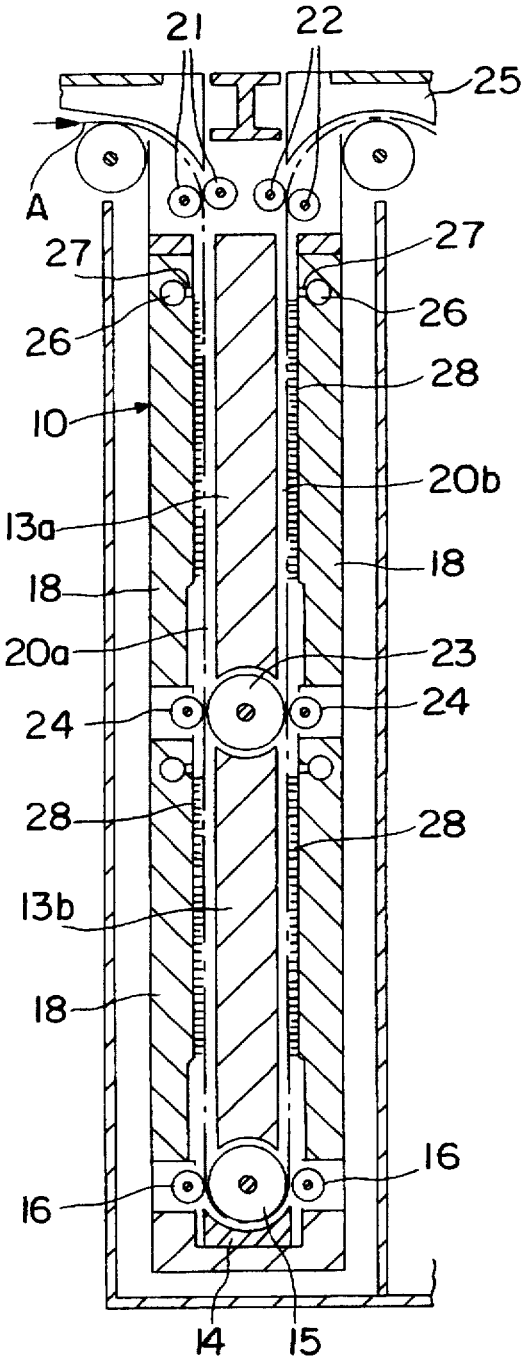
FIG. 3 is a side view in vertical section of the rack of FIG. 2.

FIGS. 2 and 3 show such a rack 10. The rack 10 has a rack body 11 comprising side frames 12 on both sides of the body 11, an upper and a lower intermediate block 13*a* and 13*b* provided between the side frames 12, a bottom turn guide 14 provided under the lower intermediate block 13*b*, a turn roller 15 adapted to be rotated in one direction, and press rollers 16 in contact with the turn roller 15 on both sides of the turn roller 15.

Each side frame 12 has upper and lower recesses 17 in its front and rear side. A rack plate 18 is detachably fitted in each recess 17 and secured in position by rotating knobs 19 so as not to come off the body 11. By fitting the rack plates 18, a straight downward feed path 20*a* and a straight upward feed path 20*b* for guiding photosensitive material A are defined between the rack plates 18 and the intermediate blocks 13*a* and 13*b*.

The feed paths 20*a* and 20*b* have a slit-like section with a narrow width of 0.3–5 mm.

Infeed rollers 21 are provided over the downward feed path 20*a*. Delivery rollers 22 are provided over the upward feed path 20*b*. A feed roller 23 adapted to be rotated in one direction is provided at the center of feed paths 20*a*, 20*b*. Press rollers 24 are pressed against the feed roller 23 from both sides.

Photosensitive material A is fed along the downward feed path 20*a* by the rotating infeed rollers 21, turned 180° by the bottom turn guide 14 and the turn roller 15, fed upward along the upward feed path 20*b*, and fed out of the rack by the rotating delivery rollers 22.

Photosensitive material A is fed with its emulsion surface facing the rack plates 18.

Photosensitive material A discharged from one rack 10 is guided by a top turn guide 25 into the rack 10 in the adjacent tank.

While the photosensitive material A is being fed through the rack 10, treating solution is fed under pressure through passages 26 formed in the rack plates 18 and discharged at the material A being fed through the downward and upward feed paths 20*a* and 20*b*. Photosensitive material is thus developed instantly by uniformly coming into contact with the treating solution.

As shown in FIG. 2, each rack plate 18 has first inclined grooves 29 and second inclined grooves 30 inclined in an opposite way to the first grooves 29 and arranged alternating with the first grooves 29 in the feed direction of photosensitive material A. A chemical-resistant fiber-planted member 31 is detachably received in each of the grooves 29, 30.

Figure 5:
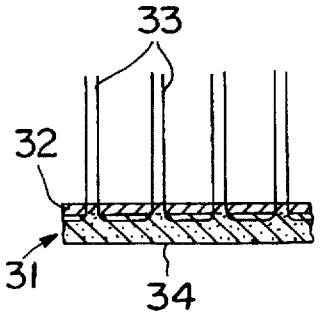
FIG. 5 is a sectional view of a fiber-planted member.

As shown in FIG. 5, each fiber-planted member 31 comprises a flexible base 32 such as cloth, and soft fibers 33 planted in the base 32 by piercing. A latex compound layer 34 is provided on the back of the base 32 to prevent the fibers 33 from falling out.

The fibers 33 may be made from polypropylene, nylon, polyester, polyethylene or cellulose triacetate.

The length of the fibers 33 may be shorter or longer than the clearance of the feed paths 20*a*, 20*b*.

Figure 4:
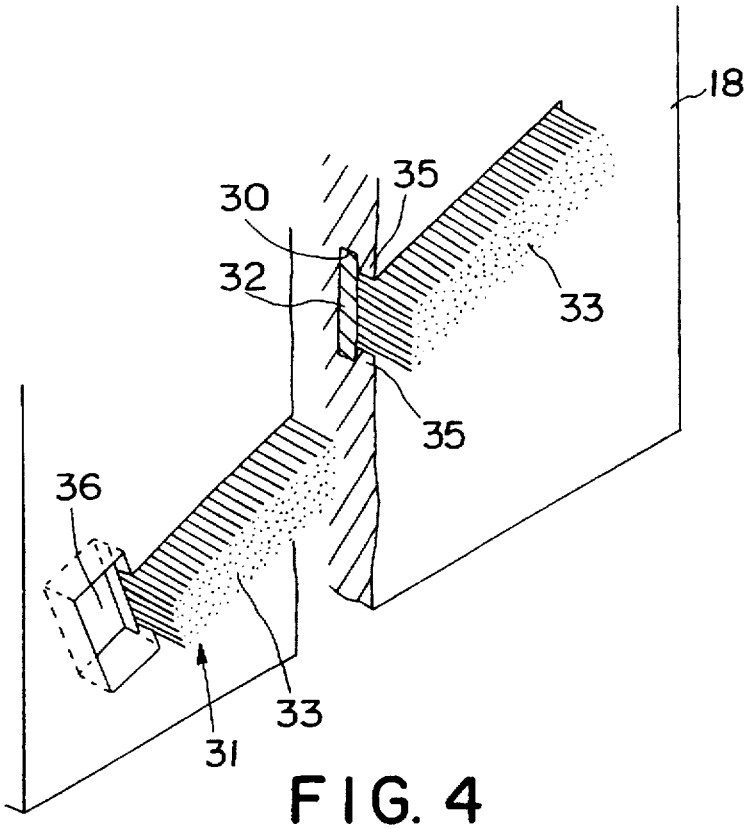
FIG. 4 is a sectional view of a portion of where fiber-planted members are mounted.

As shown in FIG. 4, each second groove 30 has ribs 35 along the top side edges to prevent the fiber-planted member 31 from coming out of the groove 30. The member 31 is inserted into the groove 30 through a recess 36 formed at one end of the groove 30.

While not shown, the first grooves 29 have the same structure as shown in FIG. 4 and can detachably accept fiber-planted members 31 in exactly the same manner as the second grooves 30.

The fibers 33 of the fiber-planted members 31 set in the first and second grooves 29 and 30 formed in the inner surface of each rack plate 18 protrude into the feed paths 20*a*, 20*b* and prevent the emulsion surface of photosensitive material A from coming into direct contact with the inner surfaces of the rack plates while the photosensitive material A is being fed through the feed paths. The photosensitive material A is thus kept scratch-free.

Since the first and second grooves 29 and 30 are inclined relative to the feed direction of photosensitive material A, the photosensitive material A comes into contact with fibers 33 from its one end toward the other end. It is thus possible to feed the material A without the possibility of clogging.

Since the first and second grooves 29 and 30 are inclined in opposite ways to each other, the members 31 received in the grooves 29 and 30 can prevent meandering of the photosensitive material A.

When fibers 33 of any fiber-planted members 31 buckle or become worn by contact with photosensitive material A, the rack plates 18 are dismounted, and the old fiber-planted members 31 are pulled out of the grooves 29, 30 to replace them with new ones.

The fiber-planted members 31 may be detachably fitted in the guide surfaces of the intermediate guide blocks 13*a*, 13*b* for guiding photosensitive material A.

Figure 6:
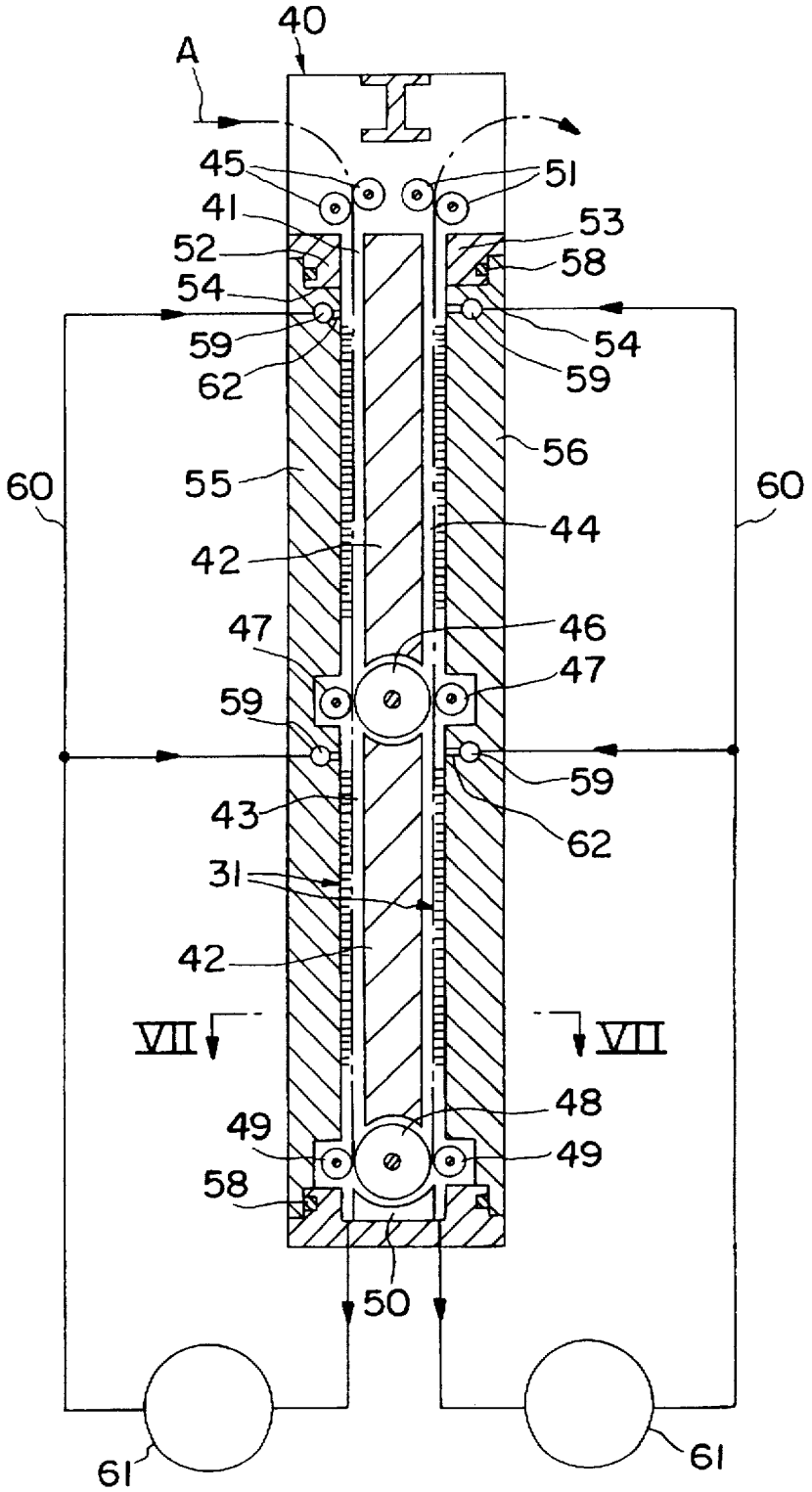
FIG. 6 is a front view in vertical section of another embodiment of the automatic developing machine according to this invention.
Figure 7:
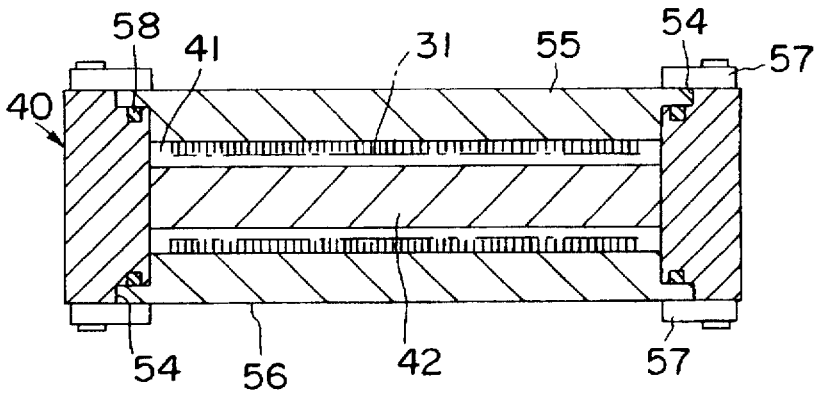
FIG. 7 is a sectional view taken along line VII—VII of FIG. 6.
Figure 8:
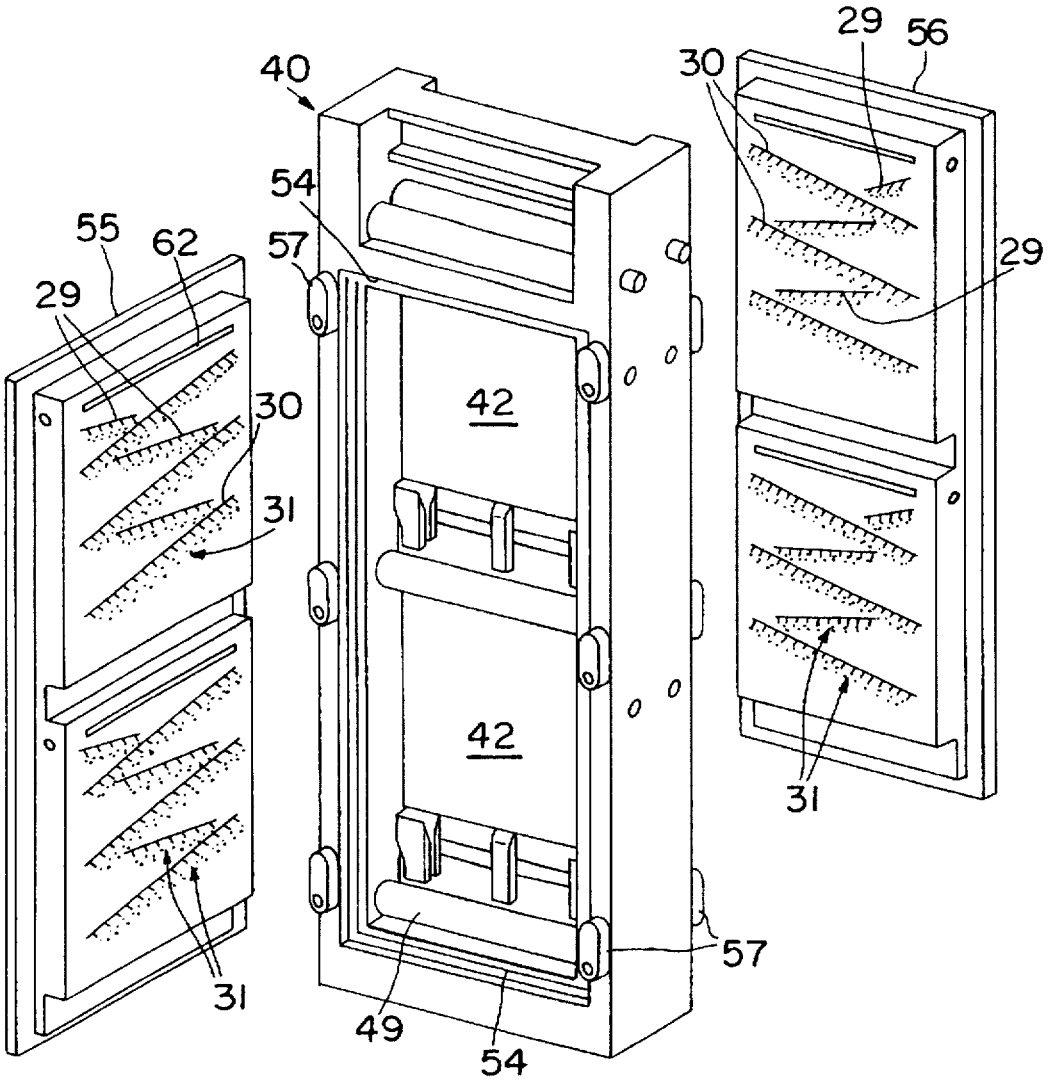
FIG. 8 is an exploded perspective view of the device of FIG. 6.

FIGS. 6–8 show another embodiment of this invention, in which feed paths are provided in the tanks filled with a developer, fixer, stabilizer, and other developing solutions.

Each tank 40 has an open-topped space 41 filled with developing solution. Plate members 42 are mounted one over the other in the space 41 to define slit-shaped feed paths 43, 44 in front and back thereof. A pair of infeed rollers 45 are provided over the feed path 43. Photosensitive material A is fed into the feed path 43 by the rotating infeed rollers 45 and fed downward through the path 43 by a feed roller 46 provided between the upper and lower plate members 42 and press rollers 47.

Photosensitive material A is fed downward by the rollers 46, 47, and turned 180° by a turn roller 48 and press rollers 49 provided under the lower plate member 42 along a turn guide 50 provided under the turn roller 48.

Photosensitive material A is then fed upward through the feed path 44 first by the turn roller 48 and press rollers 49 and then by the feed roller 46 and the press roller 47. Photosensitive material A is thus fed out of one tank and fed into the adjacent tank, not shown, by a pair of delivery rollers 51 provided over the feed path 44.

The feed paths 43 and 44 are defined between the plate members 42 and front and back walls 52 and 53. The walls 52, 53 have openings 54 in which are detachably received a front plate 55 and a back plate 56. Knobs 57 (FIG. 7) are provided on both sides of the tank 40. The knobs 57 are turned to engage the front surfaces of the front and back plates 55, 56 to prevent them from coming off the tank. In this state, seal members 58 provided along the edges of the openings 54 are pressed against the inner surfaces of the plates 55, 56, thus sealing the contact portion between the tank body and the plates 55, 56.

A plurality of lateral passages 59 are formed one over another in the front plate 55 and the back plate 56. The passages 59 communicate with the bottom of the space 41 through circulation paths 60 each having a pump 61.

The pumps 61 pressurize and feed the developing solution in the space 41 into the passages 59. Developing solution fed into the passages 59 is discharged through nozzles 62 connected to the passages 59 at the emulsion surface of photosensitive material A being fed through the feed paths 43, 44. The photosensitive material A is thus developed by coming into contact with developing solution.

Since photosensitive material A is developed while being fed through the slit-shaped feed paths 43, 44, the material A tends to suffer scratches on its emulsion surface by coming into contact with the wall surfaces defining the feed paths 43, 44.

In order to prevent such trouble, fiber-planted members 31 are detachably fitted in first grooves 29 and second grooves 30 formed in the inner surfaces of the front plate 55 and back plate 56, i.e. the surfaces facing the emulsion surface of photosensitive material A.

The first grooves 29, second grooves 30 and fiber-planted members 31 are identical in structure to those shown in FIGS. 2 and 4. Like parts are denoted by like numerals and their description is omitted.

In this arrangement, photosensitive material A is fed through the feed paths 43, 44 with its emulsion surface guided by the soft fibers of the fiber-planted members 31 provided in the front plate 55 and the back plate 56, so that the material A can be kept free of scratches on its emulsion surface.

Similar fiber-planted members 31 may be fitted on the surfaces of the plate members 42 too.

If fibers 33 of any fiber-planted members 31 buckle or become worn, the front plate 55 and back plate 56 are dismounted, and the old fiber-planted members 31 are replaced with new ones.

According to the present invention, simply by removing one of the opposed wall members defining the feed paths of photosensitive material, any fiber-planted members can be replaced with new ones. Thus, maintenance is easy. Also, this arrangement is economical because it is possible to replace only some of the fiber-planted members whose fibers have buckled or become worn.

The first and second grooves in which the fiber-planted members are detachably fitted are inclined in opposite ways to each other with respect to a straight line perpendicular to the feed direction of photosensitive material. This makes it possible to smoothly feed photosensitive material without the possibility of clogging.

The latex compound layer provided on the back of the base effectively prevents the fibers planted in the base by piercing from falling out. This prolongs the life of the fiber-planted members and thus the intervals between replacements of the members.

What is claimed is:

1. An automatic developing machine for developing photosensitive material while feeding said photosensitive material through a feed path through which developing solution is circulated, said feed path having a narrow, slit-shaped section, said feed path being defined between a pair of opposed wall members, one of which can be disassembled from the other, wherein members planted with fiber are detachably fitted on guide surfaces of said wall members which face an emulsion surface of the photosensitive material.

2. An automatic developing machine as claimed in claim 1 wherein said feed path is formed in a rack immersed in developing solution in a tank, said rack having a pair of rack plates detachably mounted at the front and back sides of said rack, said rack plates being one of said wall members defining said feed path.

3. An automatic developing machine as claimed in claim 1 wherein said feed path is formed in a tank filled with developing solution, said tank having a pair of plates detachably mounted at the front and back sides of said tank, said plates being one of said wall members defining said feed path.

4. An automatic developing machine as claimed in claim 1 wherein said wall members have in said guide surfaces first and second grooves inclined in opposite ways to each other with respect to a straight line perpendicular to the direction in which photosensitive material is fed through said feed path, said fiber-planted members being detachably received in said first and second grooves.

5. An automatic developing machine as claimed in claim 1 wherein each of said fiber-planted members comprises a flexible base, fibers pierced through said base and protruding from the front side of said base, and a latex compound layer provided on the back of said base.

* * * * *